US012251039B2

(12) United States Patent
Davis et al.

(10) Patent No.: US 12,251,039 B2
(45) Date of Patent: Mar. 18, 2025

(54) FOLDING PILLOW

(71) Applicant: Pillow Cube, Inc., Lindon, UT (US)

(72) Inventors: Jay Davis, Lindon, UT (US); Damian Dayton, Lehi, UT (US); Brandon Barney, Lehi, UT (US)

( * ) Notice: Subject to any disclaimer, the term of this patent is extended or adjusted under 35 U.S.C. 154(b) by 219 days.

(21) Appl. No.: 17/723,444

(22) Filed: Apr. 18, 2022

(65) Prior Publication Data

US 2022/0330733 A1 Oct. 20, 2022

Related U.S. Application Data

(60) Provisional application No. 63/176,249, filed on Apr. 17, 2021.

(51) Int. Cl.
*A47G 9/10* (2006.01)

(52) U.S. Cl.
CPC ..... *A47G 9/1045* (2013.01)

(58) Field of Classification Search
CPC ..... A47G 9/1045; A47C 7/021; A47C 20/02; A47C 17/045; A47C 13/005
See application file for complete search history.

(56) References Cited

U.S. PATENT DOCUMENTS 3,761,131 A * 9/1973 Oliver ..... A47C 27/086 5/652
4,843,662 A * 7/1989 Handelman ..... A47C 7/021 297/382
4,930,170 A * 6/1990 Kobayashi ..... A47C 23/005 5/691
5,190,350 A * 3/1993 Hwang ..... A47C 1/143 297/226
5,491,851 A * 2/1996 Alonso ..... A47C 27/001 5/722
5,765,245 A * 6/1998 Breto ..... A47G 9/10 5/636
7,752,692 B1 * 7/2010 Sanders ..... A47D 5/006 5/655
8,375,482 B1 2/2013 Owens
10,925,382 B1 * 2/2021 Jones ..... A47G 9/08
11,375,821 B1 * 7/2022 Purvis ..... A47C 3/16
2008/0028529 A1 2/2008 Abell
2008/0120786 A1 * 5/2008 Furlow ..... A47C 7/021 5/737
2008/0163427 A1 * 7/2008 Howe ..... A47C 20/027 5/634
2017/0332793 A1 * 11/2017 Caluwaert ..... A47C 1/146
(Continued)

OTHER PUBLICATIONS

Matos "PCT International Search Report for International Application No. PCT/US2022/025254" mailed Jul. 7, 2022, 2 pages.
(Continued)

*Primary Examiner* — Myles A Throop

(57) ABSTRACT

A folding pillow includes a top pillow section and a bottom pillow section. The top pillow section includes a first access opening, and a first internal pillow insert. The bottom pillow section includes a second access opening, and a second internal pillow insert. The folding pillow also includes a hinge section, where the folding pillow is configured to fold at the hinge section and have a folded position and an unfold position. The folding pillow also includes a sleeping panel, where the sleeping panel is covered when the folding pillow is in the folded position.

13 Claims, 6 Drawing Sheets

(56) References Cited

U.S. PATENT DOCUMENTS

| | | | | |
|---|---|---|---|---|
| 2017/0332812 | A1* | 11/2017 | Colton | A47G 9/10 |
| 2018/0028002 | A1* | 2/2018 | Lou | A47G 9/1081 |
| 2019/0380460 | A1* | 12/2019 | Marsh | A45F 4/02 |

OTHER PUBLICATIONS

Matos "Written Opinion of the International Searching Authority for International Application No. PCT/US2022/025254" mailed Jul. 7, 2022, 5 pages.

* cited by examiner

FOLDING PILLOW

RELATED APPLICATIONS

This application claims the benefit of U.S. Provisional Patent Application No. 63/176,249, filed Apr. 17, 2021, which is incorporated herein by reference in its entirety.

BACKGROUND

This disclosure relates generally to a folding pillow.

SUMMARY

The subject matter of the present application has been developed in response to the present state of the art, and in particular, in response to the problems and disadvantages associated with conventional pillows that have not yet been fully solved by currently available techniques. Accordingly, the subject matter of the present application has been developed to provide embodiments of a system, apparatus, and method that overcome at least some of the shortcomings of prior art techniques.

Disclosed herein is a folding pillow. The folding pillow includes a top pillow section and a bottom pillow section. The top pillow section includes a first access opening, and a first internal pillow insert. The bottom pillow section includes a second access opening, and a second internal pillow insert. The folding pillow also includes a hinge section, where the folding pillow is configured to fold at the hinge section and have a folded position and an unfold position. The preceding subject matter of this paragraph characterizes example 1 of the present disclosure.

The folding pillow further includes a flap panel, wherein the first flap panel is a rear flap panel. The preceding subject matter of this paragraph characterizes example 2 of the present disclosure, wherein example 2 also includes the subject matter according to example 1, above.

The folding pillow further includes a second flap panel, wherein the second flap panel is a first side flap panel. The preceding subject matter of this paragraph characterizes example 3 of the present disclosure, wherein example 3 also includes the subject matter according to any one of examples 1-2, above.

The folding pillow further includes a sleeping panel, wherein the sleeping panel is covered when the folding pillow is in the folded position. The preceding subject matter of this paragraph characterizes example 4 of the present disclosure, wherein example 4 also includes the subject matter according to any one of examples 1-3, above.

The sleeping panel includes no seams or stitching in a central section of the sleeping panel. The preceding subject matter of this paragraph characterizes example 5 of the present disclosure, wherein example 5 also includes the subject matter according to any one of examples 1-4, above.

The hinge section includes a portion of the sleeping panel, a portion of the first side flap panel, and a portion of a second side flap panel. The preceding subject matter of this paragraph characterizes example 6 of the present disclosure, wherein example 6 also includes the subject matter according to any one of examples 1-5, above.

The folding pillow is configured to have the top and bottom pillow sections match up along a closed contact edge when in a folded position. The preceding subject matter of this paragraph characterizes example 7 of the present disclosure, wherein example 7 also includes the subject matter according to any one of examples 1-6, above.

The top pillow section is larger than the bottom pillow section. The preceding subject matter of this paragraph characterizes example 8 of the present disclosure, wherein example 8 also includes the subject matter according to any one of examples 1-7, above.

The top pillow section is smaller than the bottom pillow section. The preceding subject matter of this paragraph characterizes example 9 of the present disclosure, wherein example 9 also includes the subject matter according to any one of examples 1-7, above.

The first side flap panel of the bottom pillow section is stitched to a second side flap panel of the top pillow section, wherein a union of the first and second side flap panels is in the hinge section. The preceding subject matter of this paragraph characterizes example 10 of the present disclosure, wherein example 10 also includes the subject matter according to any one of examples 1-9, above.

The folding pillow includes an opening between the first side flap panel, the second side flap panel, and the sleeping panel. The preceding subject matter of this paragraph characterizes example 11 of the present disclosure, wherein example 11 also includes the subject matter according to any one of examples 1-10, above.

The folding pillow includes a second opening opposite to the opening. The preceding subject matter of this paragraph characterizes example 12 of the present disclosure, wherein example 12 also includes the subject matter according to any one of examples 1-11, above.

The first side panel flap comprises a first side flap tab. The preceding subject matter of this paragraph characterizes example 13 of the present disclosure, wherein example 13 also includes the subject matter according to any one of examples 1-12, above.

The second side panel flap comprises a second side flap tab. The preceding subject matter of this paragraph characterizes example 14 of the present disclosure, wherein example 14 also includes the subject matter according to any one of examples 1-13, above.

The first side panel flap and the second side panel flap are sewn together at the first and second side flap tabs, wherein the first and second side flap tabs are folded back into an interior of the folding pillow. The preceding subject matter of this paragraph characterizes example 15 of the present disclosure, wherein example 15 also includes the subject matter according to example 14, above.

Disclosed herein is a folding pillow. The folding pillow includes a top pillow section and a bottom pillow section. The top pillow section includes a first access opening, and a first internal pillow insert. The bottom pillow section includes a second access opening, and a second internal pillow insert. The folding pillow also includes a hinge section, where the folding pillow is configured to fold at the hinge section and have a folded position and an unfold position. The folding pillow further includes a sleeping panel, wherein the sleeping panel is covered when the folding pillow is in the folded position. The folding pillow is configured to have the top and bottom pillow sections match up along a closed contact edge when in a folded position. The preceding subject matter of this paragraph characterizes example 16 of the present disclosure.

A first side flap panel of the bottom pillow section is stitched to a second side flap panel of the top pillow section, wherein a union of the first and second side flap panels is in the hinge section. The preceding subject matter of this paragraph characterizes example 17 of the present disclosure, wherein example 17 also includes the subject matter according to example 16, above.

The folding pillow includes an opening between the first side flap panel, the second side flap panel, and the sleeping panel. The preceding subject matter of this paragraph characterizes example 18 of the present disclosure, wherein example 18 also includes the subject matter according to any one of examples 16-17, above.

The first side panel flap comprises a first side flap tab and wherein the second side panel flap comprises a second side flap tab. The preceding subject matter of this paragraph characterizes example 19 of the present disclosure, wherein example 19 also includes the subject matter according to any one of examples 16-18, above.

The first side panel flap and the second side panel flap are sewn together at the first and second side flap tabs, wherein the first and second side flap tabs are folded back into an interior of the folding pillow. The preceding subject matter of this paragraph characterizes example 20 of the present disclosure, wherein example 20 also includes the subject matter according to example 19, above.

BRIEF DESCRIPTION OF THE DRAWINGS

In order that the advantages of the subject matter may be more readily understood, a more particular description of the subject matter briefly described above will be rendered by reference to specific embodiments that are illustrated in the appended drawings. Understanding that these drawings depict only typical embodiments of the subject matter and are not therefore to be considered limiting of its scope, the subject matter will be described and explained with additional specificity and detail through the use of the drawings, in which.

Figure 1:
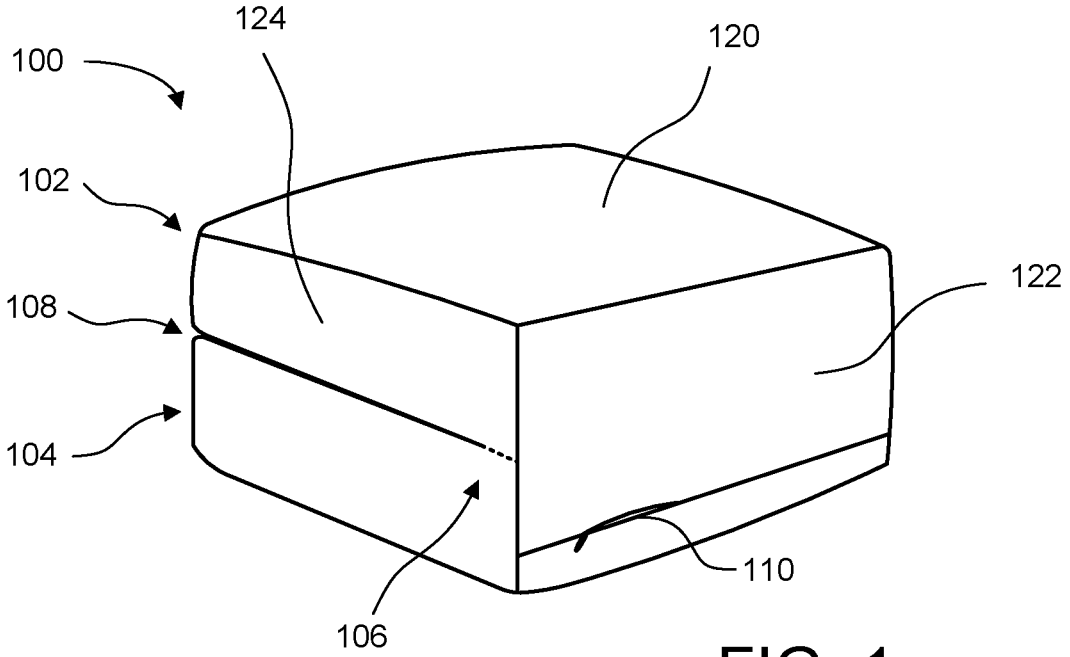
FIG. 1 depicts a rear perspective view of one embodiment of a folding pillow in a folded position.

| Reference # | Designation |
|---|---|
| 100 | Folding pillow |
| 102 | Top pillow section |
| 104 | Bottom pillow section |

-continued

| Reference # | Designation |
|---|---|
| 106 | Hinge section |
| 108 | Closed contact edge |
| 110 | Access opening |
| 120 | Top pillow material pattern |
| 122 | Rear flap panel |
| 124 | Side flap panel |
| 126 | Front flap panel |
| 130 | Internal sleeping panel |
| 132 | Hole |
| 140 | Tab stitch line |
| 142 | Side flap tab |
| 144 | Margin stitch line |
| 146 | Side flap panel (second embodiment) |
| 148 | Side flap tab (second embodiment) |
| 150 | Sleeping panel stitch line |
| 160 | Top pillow material pattern (third embodiment) |
| 170 | Side flap panel (third embodiment) |
| 172 | Side flap tab (third embodiment) |
| 174 | Tab stitch line (third embodiment) |
| 176 | Front flap panel (third embodiment) |
| 178 | Rear flap panel (third embodiment) |
| 200 | Characterized folding pillow (whale) |
| 202 | Decorative tail flap |
| 204 | Decorative fin flap |
| 206 | Decorative Eye |
| 208 | Decorative Mouth Stitching |
| 300 | Pillow travel system |
| 302 | Carrying case |
| 304 | Attachment buttons |
| 310 | Tote bag carrying case |
| 312 | Tote bag straps |
| 320 | Backpack carrying case |
| 322 | Backpack straps |
| 100 | Folding pillow |
| 102 | Top pillow section |
| 104 | Bottom pillow section |
| 106 | Hinge section |
| 108 | Closed contact edge |
| 110 | Access opening |

Throughout this application, similar designations or vocabulary may be used to identify similar elements, although the breadth of this disclosure should be understood to incorporate any alternatives and variations referenced within the specification (including the claims) and the accompanying drawings.

DETAILED DESCRIPTION

It will be readily understood that the components of the embodiments as generally described herein and illustrated in the appended figures could be arranged and designed in a wide variety of different configurations. Thus, the following more detailed description of various embodiments, as represented in the figures, is not intended to limit the scope of the present disclosure but is merely representative of various embodiments. While the various aspects of the embodiments are presented in drawings, the drawings are not necessarily drawn to scale unless specifically indicated.

The present invention may be embodied in other specific forms without departing from its spirit or essential characteristics. The described embodiments are to be considered in all respects only as illustrative and not restrictive. The scope of the invention is, therefore, indicated by the appended claims rather than by this detailed description. All changes which come within the meaning and range of equivalency of the claims are to be embraced within their scope.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussions of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize, in light of the description herein, that the invention can be practiced without one or more of the specific features or advantages of a particular embodiment. In other instances, additional features and advantages may be recognized in certain embodiments that may not be present in all embodiments of the invention.

Reference throughout this specification to "one embodiment," "an embodiment," or similar language means that a particular feature, structure, or characteristic described in connection with the indicated embodiment is included in at least one embodiment of the present invention. Thus, the phrases "in one embodiment," "in an embodiment," and similar language throughout this specification may, but do not necessarily, all refer to the same embodiment.

While many embodiments are described herein, at least some of the described embodiments disclose a folding pillow. The folding pillow includes a top pillow section and a bottom pillow section connected by a hinge section. The folding pillow has a folded position and an unfolded position. In the folded position, the folding pillow resembles an animal and one or more seams from the hinge section are hidden to enhance comfort and support of a user. In the unfolded position, the folding pillow has a sleeping surface for the user. In the unfolded position, the one or more seams from the hinge section are similarly hidden to enhance comfort of the user.

Additionally, disclosed are embodiments for a method of manufacturing a folding pillow. The method of manufacturing a folding pillow includes sewing corresponding side flap tabs together along a tab stitch line. Sewing the corresponding side flap tabs together securely couples the top and bottom pillow sections together in the unfolded position. The method of manufacturing a folding pillow additionally includes sewing corresponding side flap panels to front and rear panels respectively to create a top box or container and a bottom box or container. The method of manufacturing a folding pillow also includes inserting pillow inserts into the top and bottom boxes to create the folding pillow and sewing a sleeping surface panel across a stitch line of the folding pillow.

FIG. 1 depicts a rear perspective view of one embodiment of a folding pillow 100 in a folded position. The illustrated folding pillow 100 includes a top pillow section 102, a bottom pillow section 104, and a hinge section 106. The top and bottom pillow sections 102, 104 each include an internal pillow insert (or pillow filler material). In the folded (i.e., closed) position, the top and bottom pillow sections 102, 104 match up along a closed contact edge 108. Additionally, the illustrated folding pillow also includes an access opening 110 for inserting the pillow inserts or filler material. Although the folding pillow 100 is shown and described with certain components and functionality, other embodiments of the folding pillow 100 may include fewer or more components to implement less or more functionality.

Each of the sections of the folding pillow 100 is fabricated from materials cut into patterns. Different patterns, or different portions of each pattern, might form a panel of the assembled materials. For example, the illustrated folding pillow 100 includes a top pillow material pattern 120 that includes a rear flap panel 122 and a side flap panel 124, among other panels. Additional details of patterns and panels are shown and described in connection with FIGS. 4-6.

The access opening 110 may include a zipper, tie, button, snap, hook-and-loop fastener, magnet, or other mechanism or combination of mechanisms to open and close the access opening 110. When open, the access opening 110 provides a slot to insert a pillow insert into each of the top and bottom pillow sections 102, 104, respectively.

Figure 2:
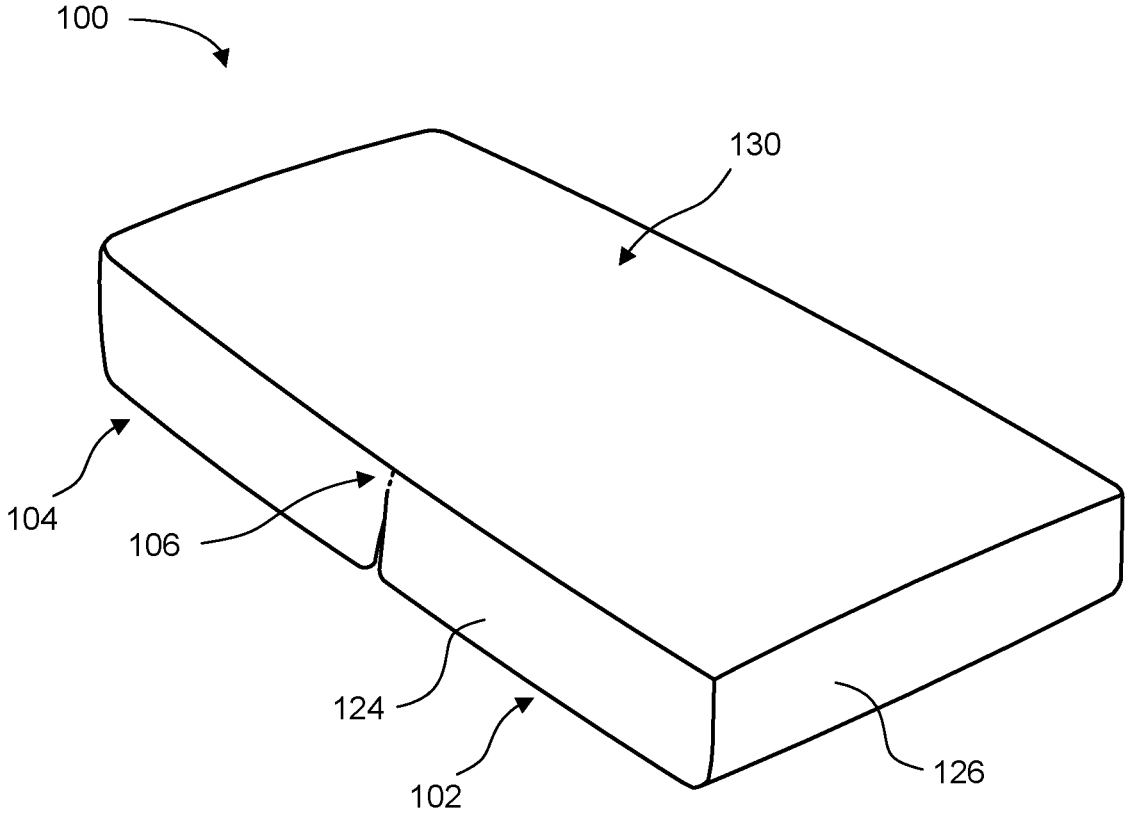
FIG. 2 depicts a top perspective view of the folding pillow of FIG. 1 in an unfolded position.

FIG. 2 depicts a top perspective view of the folding pillow 100 of FIG. 1 in an unfolded position. The illustrated folding pillow 100 includes the top and bottom pillow sections 102, 104 and the hinge section 106. The side flap panel 124 is also designated for reference with the depiction in FIG. 1. Additionally, the illustrated folding pillow 100 also includes a front flap panel 126. In comparison with FIG. 1, FIG. 2 shows how the top pillow section 102 "unfolds" at the hinge section 106 to rotate the side flap panel 124 and the front flap panel 126 (not visible in FIG. 1) away from the bottom pillow section 104.

Unfolding the top and bottom pillow sections 102, 104 reveals an internal sleeping panel 130. The internal sleeping panel 130 provides a contact surface for a user's head. In some embodiments, the internal sleeping panel 130 is devoid of seams. In other words, there is no sewing or stitching across the length or width of the central portion of the internal sleeping panel 130. Stitching is limited to the edges of the material that forms the pattern for the internal sleeping panel 130. In some embodiments, all the stitching that connects the internal sleeping panel 130 to adjacent material panels is at the corner edges between the internal sleeping panel 130 and adjacent side and end panels such as the side flap panel 120 and the front flap panel 126. In other embodiments, some or all of the stitching may be lower down the length of any side or end panel so that a portion of the internal sleeping panel 130 extends around one or more corner edges.

In addition to the absence of seams or stitching across the central portion of the internal sleeping panel 130, in some embodiments any seams or stitching across the width of the rear flap panel 122 are offset from the hinge section 106. By offsetting seams and stitching from the hinge section 106, there are no seams or stitching in contact with the underside of the internal sleeping panel 130. This allows a user to rest their head on the internal sleeping panel 130 without feeling the seams or stitching of other panels, including the rear flap panel 126, through the thickness of the internal sleeping panel 130.

In some embodiments, the dimensions and fabric qualities of the internal sleeping panel 130 cause the internal sleeping panel 130 to "pull" the top and bottom pillow sections 102, 104 together laterally when the folding pillow 100 is in the unfolded position. This helps to prevent, minimize, or reduce a potential gap between the top and bottom pillow sections 102, 104 when disposed adjacent to one another. This also provides a stable supporting surface for the user even when they are in contact with the hinge section 106 where the top and bottom pillow sections 102, 104 meet. The side flap panel 124 of the top pillow section is joined to a similar side flap panel of the bottom pillow section at 106.

A stitching between the two side flap panels is shown in FIG. 2. The stitching is also visible in FIG. 1.

In one embodiment, the top and bottom pillow sections 102, 104 are substantially square in the length and width dimensions. Additionally, in some embodiments the top and bottom pillow sections 102, 104 are matching in size and thickness. However, in other embodiments the top pillow section 102 may be larger or smaller, or a different shape, than the bottom pillow section 104. Additionally, either of the top or bottom portions may be a different shape such as a rectangle, a triangle, a circle or any other canonical or non-canonical shape.

In further embodiments, additional accessories may be added to the folding pillow 100. For example, embellishments may be added to surfaces or panels of the folding pillow 100 to create visual patterns. Alternatively, decorative embellishments may be added so the folding pillow 100 resembles an animal in the folded position (refer to FIGS. 7 and 8). In other embodiments, the folding pillow 100 may include functional attachments or designs such as external straps or external or internal pockets. Straps may be used to strap to secure the folding pillow 100 in the folded position. Alternatively, straps may be used to allow a user to carry the folding pillow 100. In other embodiments, the folding pillow 100 additionally may include a bag or carrying case to transport the folding pillow 100.

Figure 3:
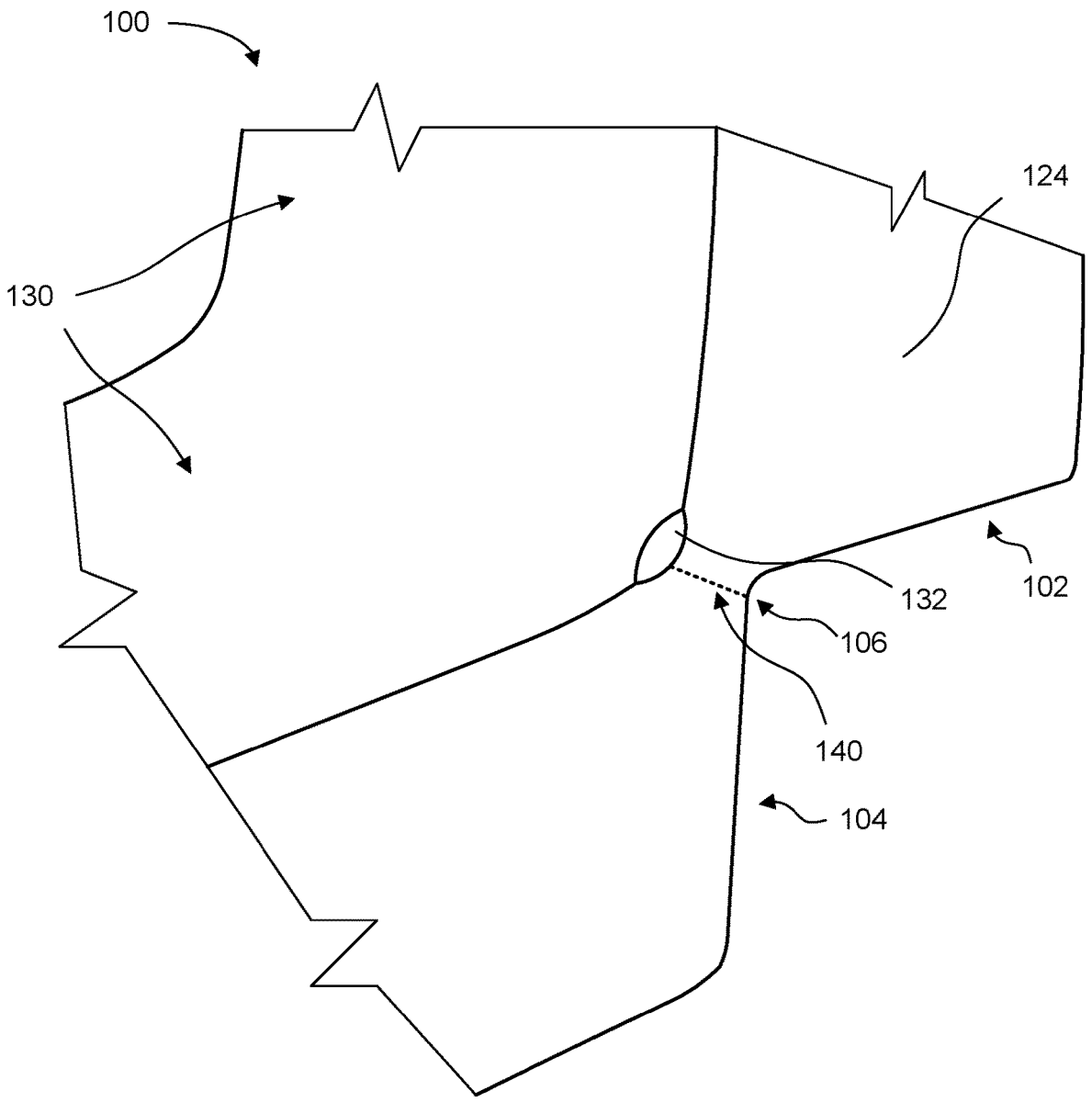
FIG. 3 depicts a close-up, side perspective view of the folding pillow of FIG. 1.

FIG. 3 depicts a close-up, side perspective view of the folding pillow 100 of FIG. 1. The illustrated view specifically highlights the location where the side flap panel(s) 124 meet one another and also meet an edge of the internal sleeping panel 130. This coincides with the hinge section 106 where the top and bottom pillow sections 102, 104 meet.

In one embodiment, the internal sleeping panel 130 is stitched to the side flap panel(s) 124, and the side flap panel(s) 124 are stitched to one another, in a way that defines a small hole 132 or opening between all of the panels. The presence of this hole 132 helps to facilitate sizing and stitching of the panels together in a way that achieves the performance described here. There may be a second opening on the other side of the folding pillow. The lack of stitching together of the pieces creates the opening and allows for the folding and unfolding to proceed in the manner described herein.

In one embodiment, the side flap panel(s) 124 are stitched together at a tab stitch line 140 aligned with the hinge section 106. Further details of the tab stitching line 140 are shown in later figures and described in more detail below. FIG. 3 also illustrates an embodiment in which the internal sleeping panel 130 has a continuous surface without any seams at the hinge section 106.

Figure 4:
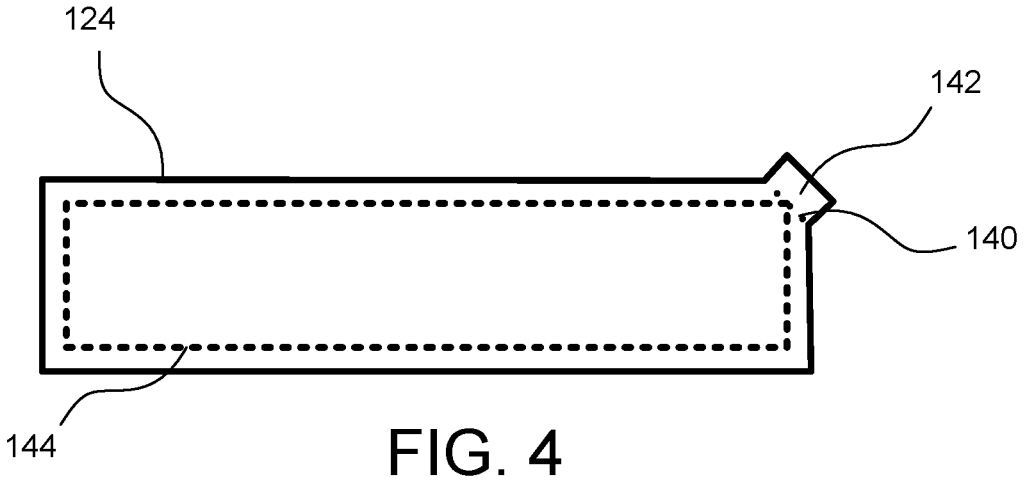
FIG. 4 depicts one embodiment of a material pattern for a side flap panel of the folding pillow of FIG. 1.

FIG. 4 depicts one embodiment of a material pattern for a side flap panel 124 of the folding pillow 100 of FIG. 1. The side flap panel 124 is used, along with other elements, to construct portions of the top and bottom pillow sections 102, 104. In some embodiments, multiple side flap panels 124 are used to construct the top and bottom pillow sections 102, 104.

The illustrated the side flap panel 124 includes a side flap tab 142 extending from the tab stitch line 140. The side flap tab 142 is sewn to a corresponding side flap tab 142 of another side flap panel 124 when constructing a top or bottom pillow section 102, 104.

The illustrated side flap panel 124 also includes a margin stitch line 144 around the perimeter of the pattern. The margin stitch line 144 indicates where the side flap panel 124 is sewn to other panels of fabric such as the front flap panel 126, the rear flap panel 122, or the internal sleeping panel 130. There is a trim portion of the pattern surrounding the outside edge of the material outside of the margin stitch line 144. Typically, the trim is hidden from view when the folding pillow 100 is fully constructed.

Figure 5:
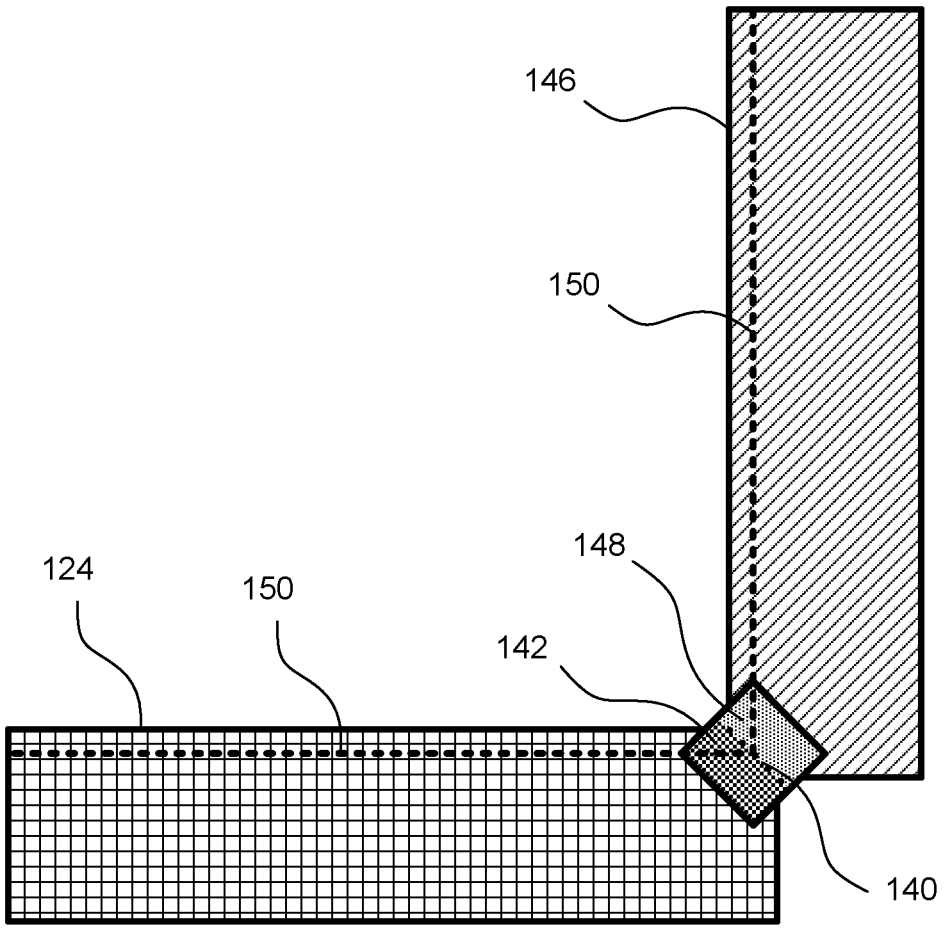
FIG. 5 depicts one embodiment of two side flap panels sewn together for the folding pillow of FIG. 1.

FIG. 5 depicts one embodiment of two side flap panels 124, 146 sewn together for the folding pillow 100 of FIG. 1. The illustrated side flap panels 124, 146 are sewn together at a common tab stitch line 140 across the length of corresponding side flap tabs 142, 148. The side flap panel 124, 146 are illustrated with various drawing patterns to show that 1) the side flap panel 124 is a different sewing panel, or separate piece of cut material, than the side flap panel 146, and 2) the side flap tabs 142, 148 are sewn together in a what that folds each side flap tab 142, 148 back into the resulting interior of the folding pillow 100. This results in hiding the side flap tabs, similar to how the trim portions of the panels are hiding inside the interior of the folding pillow 100.

FIG. 5 also designates a sleeping panel stitch line 150 that spans across the top length of the two side flap panels 124, 146. This sleeping panel stitch line indicates where the internal sleeping panel 130 is sewn together with the side flap panels 124, 146. In some embodiments, the sleeping panel stitch line 150 is continuous across the two side flap panels 124, 146. In other embodiments, the sleeping panel stitch line 150 has a small gap approximate the tab stitch line 140 in order to form the small hole 132 between the internal sleeping panel 130 and the adjacent side flap panels 124, 146.

Figure 6:
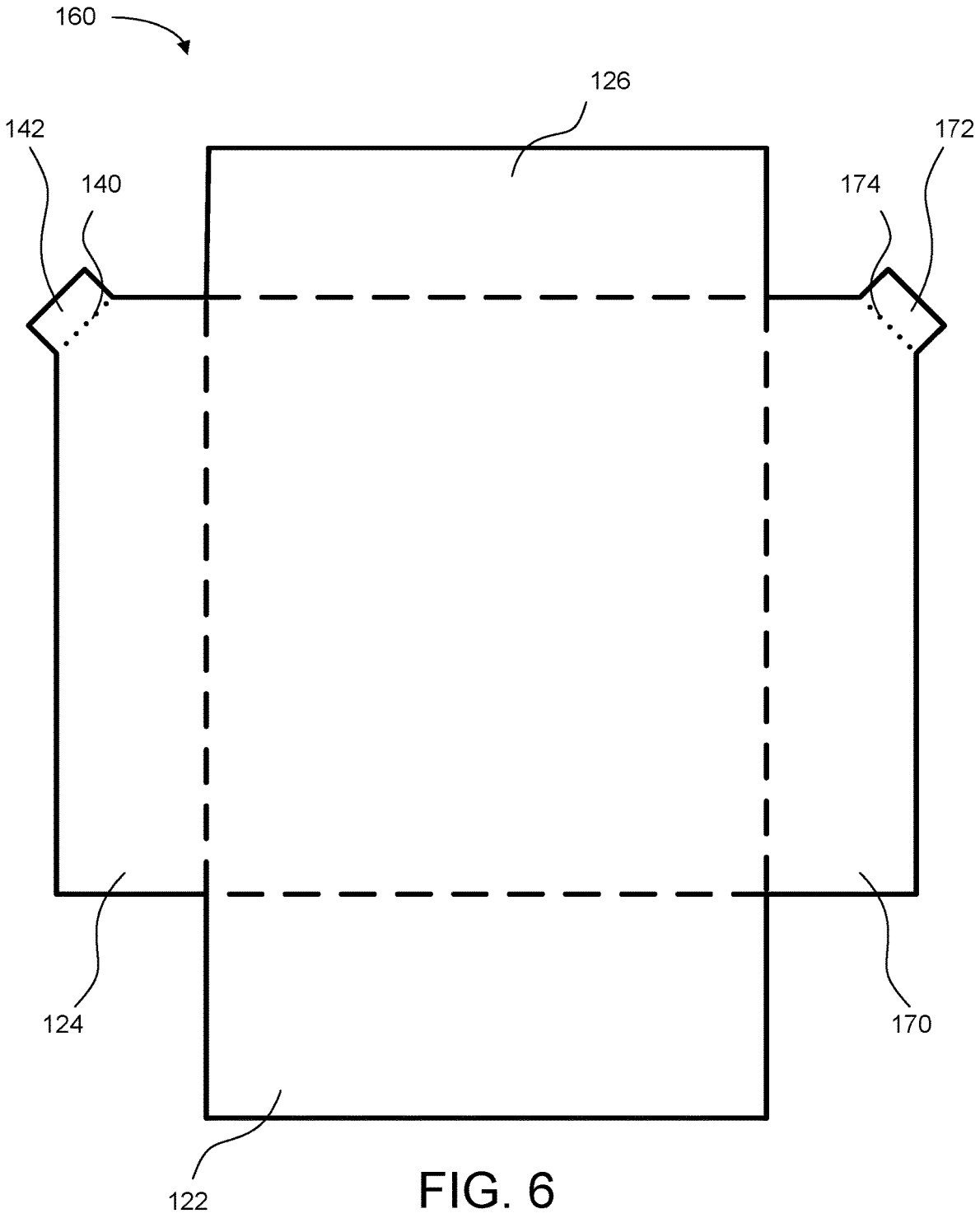
FIG. 6 depicts one embodiment of a top pillow material pattern.

FIG. 6 depicts one embodiment of a top pillow material pattern 160. The illustrated top pillow material pattern 160 shows how multiple panels of the top pillow section 102 (or, similarly, the bottom pillow section 104) might be formed from a single cut of material. As shown, the top pillow material pattern 160 includes the side flap panel 124 and an opposing side flap panel 170, the front flap panel 126, and the rear flap panel 122. The illustrated top pillow material pattern 160 also includes side flap tabs 142 and 172 and designates corresponding tab stitch lines 140 and 174.

To construct the top pillow section 102 of the folding pillow 100, edges of the side flap panels 124, 170 are sewn to the adjacent edges of the front flap panel 126 and the rear flap panel 122. This creates a rectangular box that serves as a portion of the top pillow section 102. Although shown as a single piece of material, one or more of the side flap panels 124, 170, the front flap panel 126, or the rear flap panel 122 may be a separate piece of material sewn to the central panel of the top pillow material pattern 160.

To construct the top pillow section 102 of the folding pillow 100, the side flap tab 142 of a first top pillow material pattern 160 is sewn to the side flap tab 142 of a second top pillow material pattern 160 along tab stitch line 140. Side flap tab 172 of the first top pillow material pattern 160 is then sewn to the side flap tab 172 of the second top pillow material pattern 160 along tab stitch line 174. The sewn-together pairs of side flap tabs 142, 172 create the hinge section 106 illustrated in FIG. 1. The first top pillow material pattern 160 will form the top pillow section 102 and the second top pillow material pattern 160 will form the bottom pillow section 104.

A corresponding portion of the bottom pillow section 104 may be fabricated using similar techniques. The side flap tabs 142, 172 of the top pillow material pattern 160 are then sewn together, at the tab stitch lines 140, with corresponding side flap tabs of the bottom pillow material pattern. At this point in the fabrication process, the top and bottom pillow material patterns resemble two open boxes joined together at the side flap tabs 142, 172. That is, the constructed top pillow material pattern 160 forms a 5-sided box, and a corresponding bottom pillow material pattern forms a distinct 5-sided box. Subsequently, the internal sleeping panel 130 is sewn to both the top pillow material pattern 160 and the bottom pillow material pattern 160. This completes the enclosures for the top and bottom pillow sections 102, 104. The rear panel sections are also sewn together or completed with one or more closure mechanisms (zippers, buttons, etc.).

In the sewn embodiment, the pairs of side flap tabs 142, 172 sewn together on each side of the internal sleeping surface 130 create outer edges of the hinge section 106 and are hidden internally from view by the sleeping surface 130. In some embodiments, this improves the comfort to the user as well as the stability of the folding pillow 100. Additionally, any trim pieces of material may be disposed within the sewn enclosures.

As illustrated in FIG. 6, the side flap tabs 142, 172 are integrated into the side flap panels 124, 170. In some embodiments, the side flap tabs 142, 172 are separate from the side flap panels 124, 170. Securing the top and bottom pillow sections 102, 104 to each other via the side flap tabs 142, 172 improves the coupling of the two pillow sections, and increases the overall support and stability of the folding pillow 100.

In some embodiments, the top pillow material pattern 160 includes additional panels, tabs, embellishments, or attachments that are configured to characterize the folding pillow 100 as an animal or other character while in a folded position. In some embodiments, the additional features create fins, eyes, scales, tails, horns, ears, paws, wings, or other stylistic elements. In some embodiments, the materials used for different portions of the folding pillow 100, or portions thereof, may include specific textures or printed patters corresponding to the characteristics of the intended animal or character.

Figure 7:
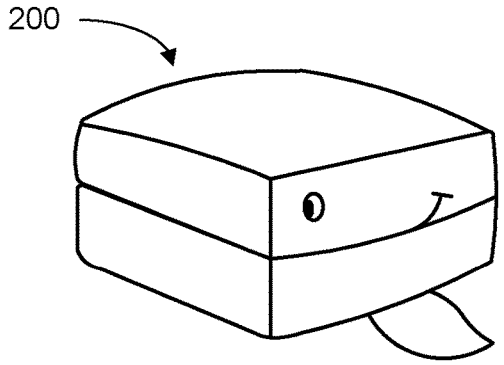
FIG. 7 depicts a front perspective view of an example characterized folding pillow in a folded position.
Figure 8:
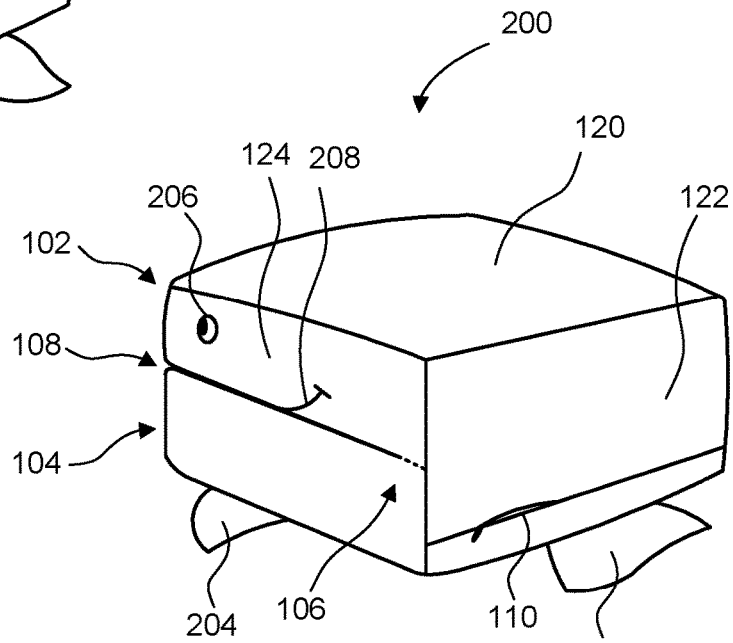
FIG. 8 depicts a rear perspective view of the characterized folding pillow of FIG. 7 in the folded position.

FIG. 7 depicts a front perspective view of an example characterized folding pillow 200 in a folded position. FIG. 8 illustrates a rear perspective view of the characterized folding pillow 200 from FIG. 7 in the folded position. As shown in both FIGS. 7 and 8, the folding pillow 200 resembles, or is characterized as, an animal in the folded position. Specifically, the illustrated folding pillow 200 characterizes a whale. In other embodiments, the folding pillow 200 may characterize any animal (e.g., a tiger, a zebra, a turtle, a dog, etc.). In the embodiment illustrated in FIGS. 7 and 8, the closed contact edge 108 contributes to the mouth features of the whale.

Figure 9:
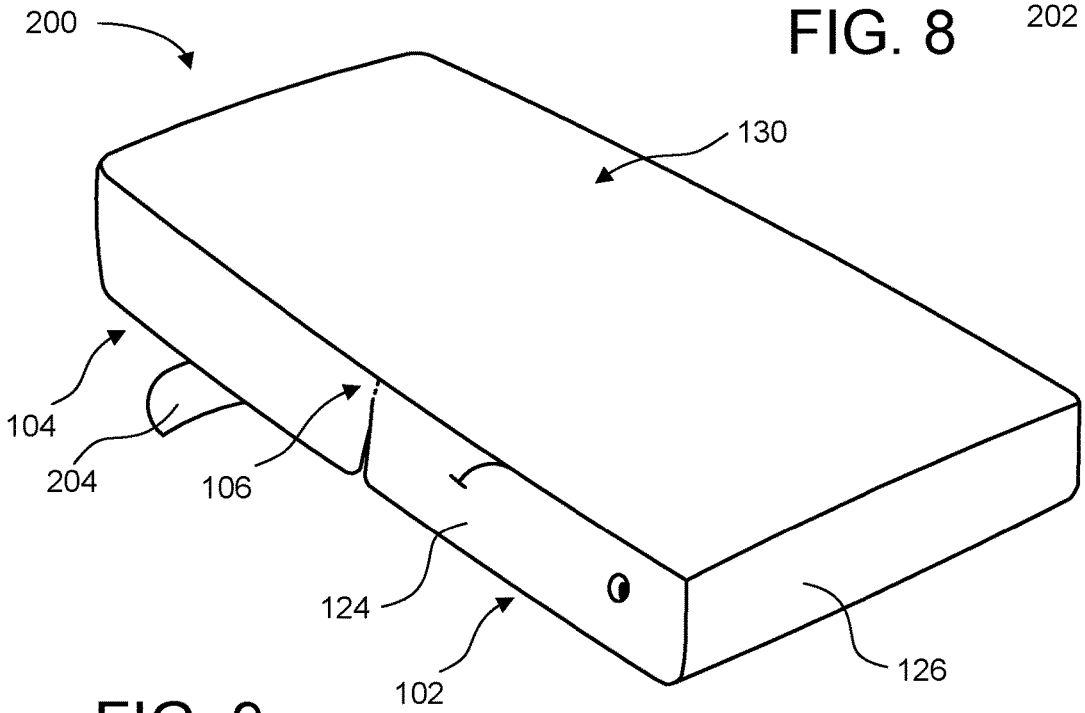
FIG. 9 depicts a top perspective view of the characterized folding pillow of FIG. 7 in an unfolded position.

FIG. 9 depicts a top perspective view of the characterized folding pillow 200 of FIGS. 7 and 8 in an unfolded position. As seen in FIG. 9, the sleeping surface 130 has no seams. In particular, the seams from the hinge section 106 are hidden. As shown in FIGS. 8 and 9, the folding pillow 200 has many of the same features as folding pillow 100 that is described more fully in conjunction with FIGS. 1-6. The features and discussion of FIGS. 1-6 apply to FIGS. 7-9 and are not repeated only for the sake of brevity. In addition to the features that were discussed in conjunction with FIGS. 1-6, FIGS. 7-9 depict various decorative features including a decorative tail flap 202, a decorative fin flap 204, a decorative eye 206, and a decorative mouth stitching 208.

Figure 10:
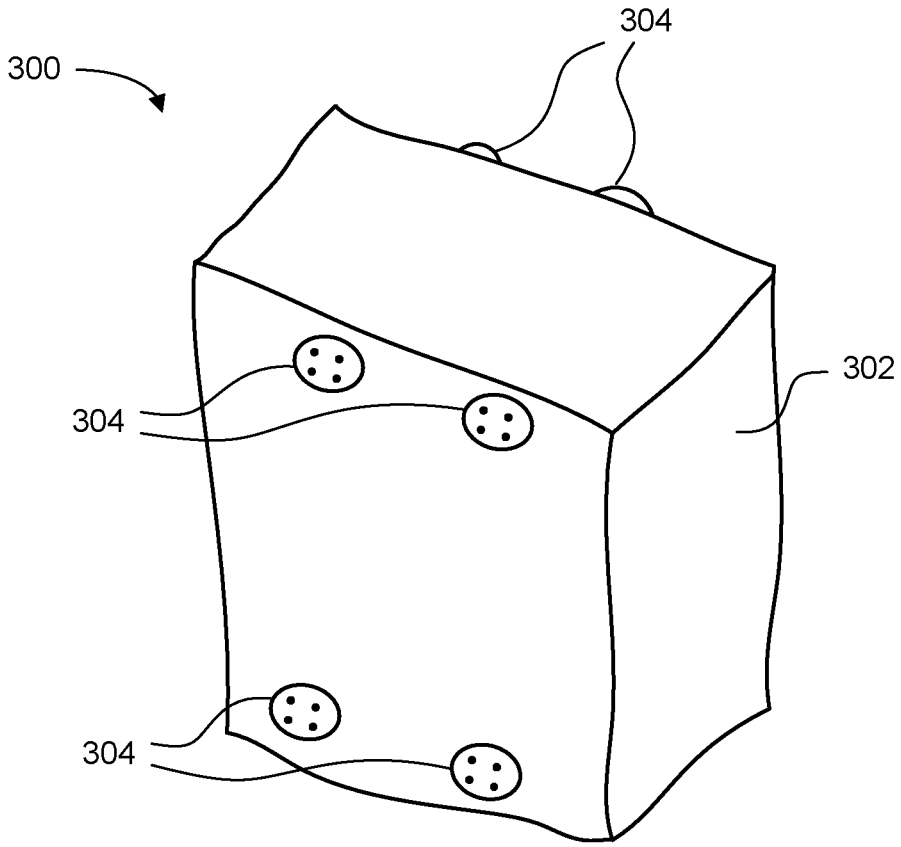
FIG. 10 depicts a side perspective view of a first embodiment of a carrying case for the folding pillow.
Figure 11:
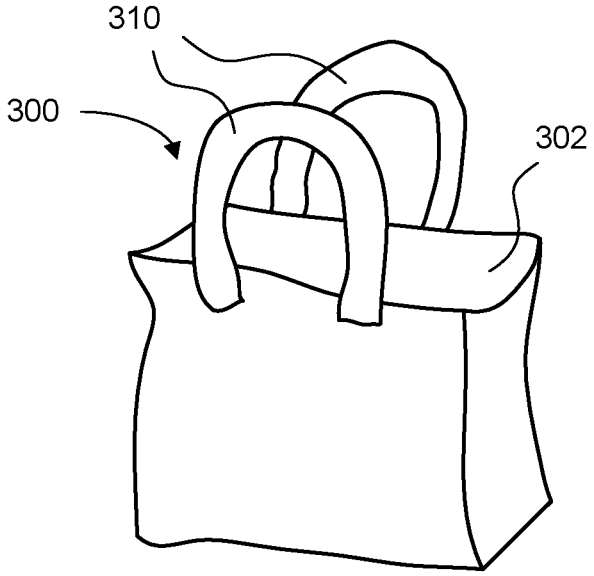
FIG. 11 depicts a back perspective view of a second embodiment of a carrying case for the folding pillow.
Figure 12:
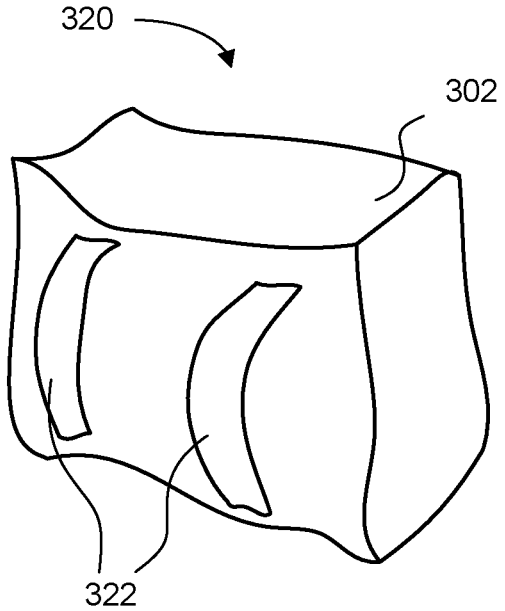
FIG. 12 depicts a side perspective view of a third embodiment of a carrying case for the folding pillow Throughout the description, similar reference numbers may be used to identify similar elements. The following list is an example of the reference numbers used in the accompanying drawings.

FIGS. 10 to 12 depict various embodiments of a pillow travel system 300 for the folding pillow 100. The pillow travel system 300 provides a convenient and configurable way to store and carry the folding pillow 100.

FIG. 10 depicts one embodiment of the pillow travel system 300. The illustrate system 300 includes a carrying case 302 and one or more attachment buttons 304. The carrying case 302 may be any shape or material (soft or hard) that accommodates storage of the folding pillow 100. The attachment buttons 304 allow the attachment of one or more straps or accessories to the carrying case 302. Although designated as buttons 304, any type of attachment mechanism, such as hook-and-loop fasteners, snaps, buttons, magnets, etc., may be used to achieve equivalent functionality as described herein. Also, although the pillow travel system 300 is shown with a specific number of attachment buttons 304 in particular locations on the carrying case, other embodiments may use a different number and/or configuration of the attachment buttons 304.

FIG. 11 depicts another embodiment of the pillow travel system 300 in the form of a tote bag 310. The tote bag 310 has straps 312 that may be used as tote bag handles. The straps 312 can be attached near an opening or top region of the tote bag 310. Additionally, the straps 312 may be connected to the tote bag 300 in any manner. For example, straps 312 may be removably attached to the tote bag 300 using attachment buttons 304 or another attachment mechanism. In an alternative embodiment, the straps 312 may be reconfigured to strap across the top opening of the tope bag 310 to secure the folding pillow 100 inside the tote bag 310.

FIG. 12 depicts another embodiment of the pillow travel system 300 in the form of a backpack 320. The backpack 320 has backpack straps 322 which may be form be attached straps to the attachment buttons 304 or another attachment mechanism. In an alternative embodiment, one or more straps 322 may be reconfigured to cross diagonally across the backpack to form a sling.

In addition to the advantages which may be achieved by implementation of the individual components of the folding pillow 100, some embodiments of the folding pillow 100 provide additional advantages over conventional technology. Particularly, the top and bottom pillow sections 102, 104 are more securely coupled together, providing a stable supporting surface for the user. For example, some embodiments of the folding pillow 100 utilize a cotton-blend material that stays taut while the folding pillow 100 is in the unfolded position and in use by a user.

In some embodiments of the folding pillow 100, an interior material may be linen, cotton, a linen-cotton blend or a poly-cotton blend. In some embodiments of the folding pillow 100, an exterior material may be plush or fuzzy to enhance comfort and play. In some embodiments, the exterior material may be fleece, flannel, velvet or velour. In some embodiments, the interior and exterior materials are the same. In some embodiments, the interior and exterior materials are different. Additionally, the sleeping surface 130 of the folding pillow 100 hides and prevents contact with any seams to increase the comfort of the user.

In the above description, specific details of various embodiments are provided. However, some embodiments may be practiced with less than all of these specific details. In other instances, certain methods, procedures, components, structures, and/or functions are described in no more detail than to enable the various embodiments of the invention, for the sake of brevity and clarity.

Although the foregoing disclosure provides many specifics, these should not be construed as limiting the scope of any of the ensuing claims. Other embodiments may be devised which do not depart from the scopes of the claims. Features from different embodiments may be employed in combination. The scope of each claim is, therefore, indicated and limited only by its plain language and the full scope of available legal equivalents to its elements.

Although the operations of the method(s) herein are shown and described in a particular order, the order of the operations of each method may be altered so that certain operations may be performed in an inverse order or so that certain operations may be performed, at least in part, concurrently with other operations. In another embodiment, instructions or sub-operations of distinct operations may be implemented in an intermittent and/or alternating manner.

In the above description, certain terms may be used such as "up," "down," "upper," "lower," "horizontal," "vertical," "left," "right," and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object. Further, the terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise.

Additionally, instances in this specification where one element is "coupled" to another element can include direct and indirect coupling. Direct coupling can be defined as one element coupled to and in some contact with another element. Indirect coupling can be defined as coupling between two elements not in direct contact with each other, but having one or more additional elements between the coupled elements. Further, as used herein, securing one element to another element can include direct securing and indirect securing. Additionally, as used herein, "adjacent" does not necessarily denote contact. For example, one element can be adjacent another element without being in contact with that element.

As used herein, the phrase "at least one of", when used with a list of items, means different combinations of one or more of the listed items may be used and only one of the items in the list may be needed. The item may be a particular object, thing, or category. In other words, "at least one of" means any combination of items or number of items may be used from the list, but not all of the items in the list may be required. For example, "at least one of item A, item B, and item C" may mean item A; item A and item B; item B; item A, item B, and item C; or item B and item C. In some cases, "at least one of item A, item B, and item C" may mean, for example, without limitation, two of item A, one of item B, and ten of item C; four of item B and seven of item C; or some other suitable combination.

As used herein, a system, apparatus, structure, article, element, component, or hardware "configured to" perform a specified function is indeed capable of performing the specified function without any alteration, rather than merely having potential to perform the specified function after further modification. In other words, the system, apparatus, structure, article, element, component, or hardware "configured to" perform a specified function is specifically selected, created, implemented, utilized, programmed, and/or designed for the purpose of performing the specified function. As used herein, "configured to" denotes existing characteristics of a system, apparatus, structure, article, element, component, or hardware which enable the system, apparatus, structure, article, element, component, or hardware to perform the specified function without further modification. For purposes of this disclosure, a system, apparatus, structure, article, element, component, or hardware described as being "configured to" perform a particular function may additionally or alternatively be described as being "adapted to" and/or as being "operative to" perform that function.

Although specific embodiments of the invention have been described and illustrated, the invention is not to be limited to the specific forms or arrangements of parts so described and illustrated. The scope of the invention is to be defined by the claims appended hereto and their equivalents.

What is claimed is:

1. A folding pillow comprising:
a top pillow section comprising:
a first access opening, and
a first internal pillow insert;
a bottom pillow section comprising:
a second access opening, and
a second internal pillow insert;
a hinge section, wherein the folding pillow is configured to fold at the hinge section;
wherein the folding pillow is configured to have a folded position and an unfold position;
a first flap panel, wherein the first flap panel is a rear flap panel;
a second flap panel, wherein the second flap panel is a first side flap panel, wherein the first side flap panel of the bottom pillow section is stitched to a second side flap panel of the top pillow section, wherein a union of the first and second side flap panels is in the hinge section;
a sleeping panel, wherein the sleeping panel is covered when the folding pillow is in the folded position; and
an opening between the first side flap panel, the second side flap panel, and the sleeping panel.

2. The folding pillow of claim 1, wherein the sleeping panel comprises no seams or stitching in a central section of the sleeping panel.

3. The folding pillow of claim 2, wherein the hinge section comprises a portion of the sleeping panel, a portion of the first side flap panel, and a portion of a second side flap panel.

4. The folding pillow of claim 1, wherein the folding pillow is configured to have the top and bottom pillow sections match up along a closed contact edge when in a folded position.

5. The folding pillow of claim 1, wherein the top pillow section is larger than the bottom pillow section.

6. The folding pillow of claim 1, wherein the top pillow section is smaller than the bottom pillow section.

7. The folding pillow of claim 1, further comprising a second opening opposite to the opening.

8. The folding pillow of claim 7, wherein the first side panel flap comprises a first side flap tab.

9. The folding pillow of claim 8, wherein the second side panel flap comprises a second side flap tab.

10. The folding pillow of claim 9, wherein the first side panel flap and the second side panel flap are sewn together at the first and second side flap tabs, wherein the first and second side flap tabs are folded back into an interior of the folding pillow.

11. A folding pillow comprising:
a top pillow section comprising:
a first access opening, and
a first internal pillow insert;
a bottom pillow section comprising:
a second access opening, and a second internal pillow insert;

a hinge section, wherein the folding pillow is configured to fold at the hinge section, wherein the folding pillow is configured to have a folded position and an unfold position; and a sleeping panel, wherein the sleeping panel is covered when the folding pillow is in the folded position, and wherein the folding pillow is configured to have the top and bottom pillow sections match up along a closed contact edge when in a folded position;

wherein a first side flap panel of the bottom pillow section is stitched to a second side flap panel of the top pillow section, wherein a union of the first and second side flap panels is in the hinge section; and an opening between the first side flap panel, the second side flap panel, and the sleeping panel.

12. The folding pillow of claim 11, wherein the first side panel flap comprises a first side flap tab and wherein the second side panel flap comprises a second side flap tab.

13. The folding pillow of claim 12, wherein the first side panel flap and the second side panel flap are sewn together at the first and second side flap tabs, wherein the first and second side flap tabs are folded back into an interior of the folding pillow.

* * * * *